US011013942B2

(12) United States Patent
Jimenez et al.

(10) Patent No.: US 11,013,942 B2
(45) Date of Patent: May 25, 2021

(54) PRESSURE MAINTENANCE DEVICE WITH AUTOMATIC SWITCHOVER FOR USE IN A FIRE PROTECTION SPRINKLER SYSTEM, AND A RELATED METHOD

(71) Applicant: The Reliable Automatic Sprinkler Co., Inc., Liberty, SC (US)

(72) Inventors: Juan Jimenez, Liberty, SC (US); Thomas Multer, Liberty, SC (US); Steven Wolin, Liberty, SC (US)

(73) Assignee: The Reliable Automatic Sprinkler Co. Inc., Liberty, SC (US)

( * ) Notice: Subject to any disclaimer, the term of this patent is extended or adjusted under 35 U.S.C. 154(b) by 186 days.

(21) Appl. No.: 16/142,967

(22) Filed: Sep. 26, 2018

(65) Prior Publication Data

US 2019/0091500 A1 Mar. 28, 2019

Related U.S. Application Data

(60) Provisional application No. 62/563,581, filed on Sep. 26, 2017.

(51) Int. Cl.
*A62C 35/68* (2006.01)
*A62C 35/64* (2006.01)
(Continued)

(52) U.S. Cl.
CPC ..... *A62C 35/68* (2013.01); *A62C 3/004* (2013.01); *A62C 35/62* (2013.01); *A62C 35/645* (2013.01)

(58) Field of Classification Search
CPC ..... A62C 35/68; A62C 35/62; A62C 35/64; A62C 35/645; A62C 3/004; A62C 3/645;
(Continued)

(56) References Cited

U.S. PATENT DOCUMENTS 4,202,180 A * 5/1980 Cox ..... F17C 13/045 137/13
5,027,905 A 7/1991 Cousineau et al.
(Continued)

OTHER PUBLICATIONS

"USNRC Technical Training Center, 0451—F206S—Fire Protection for Fuel Cycle Facilities—02—Fire Protection Features and Systems, Sep. 19, 2011, USNRC, pp. 8-16, 41, 106" (Year: 2011).*
(Continued)

*Primary Examiner* — Alex M Valvis
(74) *Attorney, Agent, or Firm* — Venable LLP

(57) ABSTRACT

A pressure maintenance device is connected to a fire protection sprinkler system having downstream piping that is exposed to freezing temperatures, and supplies a pressurized fluid to the downstream piping when the sprinkler system is in an inactivated state. When an outlet pressure sensor near an outlet of the pressure maintenance device detects that a pressure of the pressurized fluid downstream of an outlet regulator falls below a first predetermined pressure, the pressure maintenance device supplies the pressurized fluid in a primary supply mode or a secondary supply mode. The pressure maintenance device automatically switches from the primary supply mode to the secondary supply mode if a supply pressure sensor detects that a pressure of the pressurized fluid downstream of a first pressurized fluid valve, and upstream of the outlet pressure regulator, falls below a second predetermined pressure.

42 Claims, 13 Drawing Sheets

(51) Int. Cl.
*A62C 35/62* (2006.01)
*A62C 3/00* (2006.01)

(58) Field of Classification Search
CPC ..... A62C 3/66; A62C 37/50; Y10T 137/8326; Y10T 137/2569; F16K 11/24; F17C 12/045
USPC ..... 169/17
See application file for complete search history.

(56) References Cited

U.S. PATENT DOCUMENTS 5,117,916 A 6/1992 Ohta et al.
5,620,017 A * 4/1997 Yamada ..... A62C 35/68 137/312
5,816,792 A 10/1998 Spencer
6,540,028 B2 4/2003 Wood
6,581,623 B1 * 6/2003 Carpenter ..... B01D 53/0454 137/113
7,594,545 B2 9/2009 Love
7,644,775 B2 1/2010 Sundholm
7,798,239 B2 9/2010 Golinveaux et al.
8,051,915 B2 * 11/2011 Blease ..... F16K 17/386 169/16
2005/0252664 A1 * 11/2005 Clum ..... A62C 35/62 169/17
2011/0000685 A1 1/2011 Matsuoka
2011/0147016 A1 6/2011 Blease et al.
2011/0232780 A1 * 9/2011 Arnott ..... G05D 16/0666 137/505
2016/0136471 A1 * 5/2016 Groen ..... A62C 37/14 169/61
2016/0332012 A1 * 11/2016 Lenkeit ..... A62C 35/13
2018/0214725 A1 * 8/2018 Tihen ..... A62C 35/645

OTHER PUBLICATIONS

"Standard for the Installation of Sprinkler Systems," National Fire Protection Association, 2012, pp. 1-100, Chapter 8, Quincy, Massachusetts.
'FM Global Property Loss Prevention Data Sheets,' FM Global, Jan. 2014, Revision Jan. 2018, pp. 1-119, Johnston, Rhode Island.

* cited by examiner

PRESSURE MAINTENANCE DEVICE WITH AUTOMATIC SWITCHOVER FOR USE IN A FIRE PROTECTION SPRINKLER SYSTEM, AND A RELATED METHOD

This non-provisional application claims the benefit of priority under 35 U.S.C. § 119(e) to U.S. Provisional Patent Application No. 62/563,581, filed on Sep. 26, 2017, and the disclosure thereof is incorporated into this application by reference.

FIELD OF THE INVENTION

This invention relates generally to a pressure maintenance device having an automatic switch for use in a fire protection sprinkler system, and a method of using a pressure maintenance device in a fire protection sprinkler system.

BACKGROUND OF THE INVENTION

In fire protection sprinkler systems, dry-pipe sprinkler systems are typically used instead of wet-pipe sprinkler systems when a piping network of the sprinkler system will be exposed to temperatures below 40° F. In a positive pressure-type system, the piping network is charged with pressurized fluid, such as air or nitrogen, instead of water, to prevent damage to the piping network due to freezing water. Dry-pipe systems use a dry-pipe valve that holds the water in a fluid supply and serves as the interface between the pressurized fluid and the fire extinguishing fluid. When a fire occurs and a sufficient amount of heat is generated, one or more sprinklers connected to the piping network operate (i.e., open), causing the pressurized fluid in the piping network to escape through the opened sprinklers, and, therefore, causing the pressure of the pressurized fluid within the piping network to drop. Once the pressurized fluid pressure drops below a predetermined level, the dry-pipe valve opens, allowing water to flow through the piping network to the open sprinklers. Dry-pipe systems require a reliable supply of pressurized fluid to function properly. Due to the delay of water delivery from the dry-pipe valve to the open sprinklers, dry-pipe systems are subject to limitations, such as size restrictions, and may have a need for additional components, such as accelerators or exhausters.

Preaction sprinkler systems employ the same principle as dry-pipe sprinkler systems (i.e., water is not normally contained within the piping network, and instead, the piping network is at least partly filled with a pressurized fluid, such as nitrogen). Preaction sprinkler systems differ from dry-pipe sprinkler systems in that the pressurized fluid in the piping network is not required to be under pressure, a supplemental detection system is installed in the same area as the sprinklers, and a preaction valve is used to control introduction of the fire extinguishing fluid, such as water, into the piping network. Preaction valve operation depends upon one or two of the following events occurring: sprinkler activation and detection device activation.

There are three variations of preaction systems, including a non-interlock system, a single interlock system, and a double interlock preaction system. In a non-interlock system, one of either event mentioned above must occur before the preaction valve opens to admit water to the system. In a single-interlock system, the detection device must be activated in order for the preaction valve to open and admit water to the system. In a double-interlock system, both sprinkler activation and detection device activation must occur before the preaction valve opens and water is introduced into the piping network.

An advantage of preaction systems, and in particular, double-interlock preaction systems, is the dual action required for water release. This feature provides an added level of protection against inadvertent discharge of water. For this reason, preaction systems are frequently employed in water sensitive environments such as archival vaults, fine art storage rooms, rare book libraries, and computer centers.

A pressure maintenance device, also known as an air maintenance device, may be used with a dry-pipe or preaction fire protection sprinkler system to regulate the pressure of the pressurized fluid in the sprinkler system. A pressure maintenance device limits the flow rate of the pressurized fluid into such a system, so that a rate that pressurized fluid is supplied to the piping network is less than a rate at which pressurized fluid will escape from an open sprinkler. A pressure maintenance device also regulates the pressure of the pressurized fluid in the sprinkler system when the sprinklers are closed, ensuring the pressurized fluid in the piping network of the sprinkler system remains pressurized so that the sprinkler system functions as intended. In addition, a pressure maintenance device allows for a manual bypass of the pressure regulator for rapid pressurization, for example, following maintenance or testing.

Both dry-pipe and preaction systems require a reliable source of pressurized fluid, such as air or gas, in order to maintain sufficient pressure within the piping network. To this end, dry-pipe and preaction systems are connected to a fluid supply for supply of the pressurized fluid and a pressure monitoring device. For example, U.S. Pat. No. 5,027,905 (Cousineau et al.) teaches a fire sprinkler control apparatus having a solenoid valve, normally closed to prevent water from the water supply from entering into a conduit leading to fluid flow lines, a sniffer valve, and an air source connected to the sniffer valve. The sniffer valve maintains the pressure of air in the conduit and the fluid flow lines at an air pressure of 60 psi. If the pressure level in the conduit drops below 50 psi, a secondary pressure switch is provided as a precautionary measure, emitting a warning that a slow pressure leak has developed, and indicating maintenance must be performed before water is released into the fluid flow lines. If the pressure level in the conduit drops below 25 psi, a primary pressure switch opens the solenoid, thereby releasing water from the water supply into the fluid flow lines via the conduit.

Dry-pipe and preaction sprinklers systems may use a tank or tanks of liquified or compressed gas as the source of pressurized fluid for the system. When the tank or tanks supplying pressurized fluid to the system are empty or nearly empty, the pressure of the pressurized fluid in the piping network may be reduced and cause the dry-pipe or preaction valve to open admitting water to the piping network without the activation of sprinklers. In the event that ambient temperature in a protected space falls below the freezing point of water (i.e., 32° F.), the water inadvertently introduced to the piping system can freeze, rendering the system inoperative and causing damage to the piping, the sprinklers, and valves.

SUMMARY OF THE INVENTION

An object of the invention is to provide a dry-pipe or preaction fire protection sprinkler system in which supply of a pressurized fluid to the sprinkler system is provided by a first pressurized fluid supply and a second pressurized fluid supply, the supply of the pressurized fluid being automatically switched, such that the pressure of the pressurized fluid in the system can be maintained at a predetermined pressure, and unintentional introduction of fire extinguishing fluid into the piping of the sprinkler system can be avoided.

Features of the invention will be described in more detail with reference to the attached drawings.

DETAILED DESCRIPTION

Figure 1A:
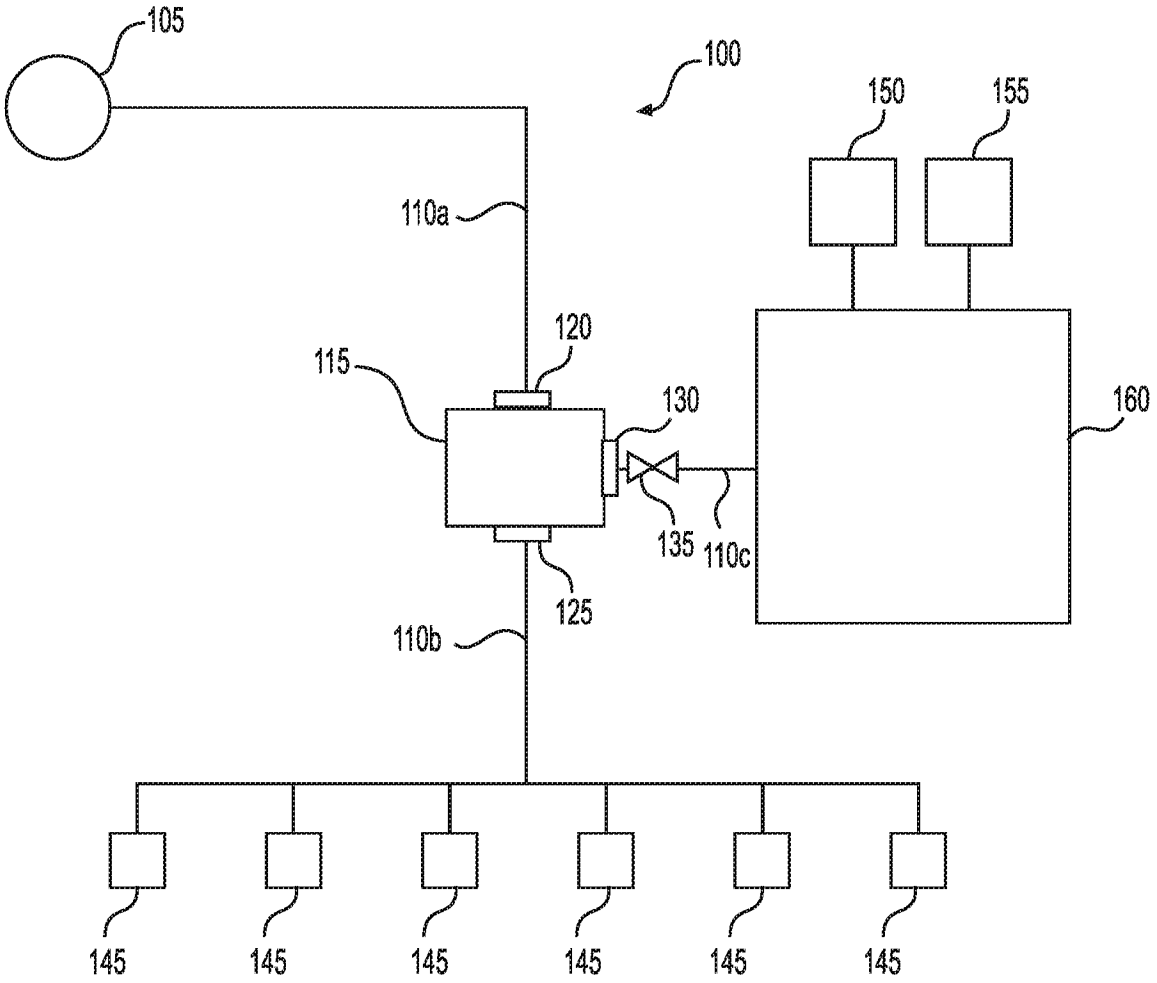
FIG. 1A is a schematic diagram illustrating a fire protection sprinkler system, including a dry-pipe valve, of an embodiment of the invention.

A fire protection sprinkler system 100, shown in FIG. 1, includes a fire extinguishing fluid supply 105 configured to supply a fire extinguishing fluid to the sprinkler system 100. The fire extinguishing fluid may be, for example, water. The fire protection sprinkler system 100 is installed in an occupancy, such as a storage facility or a warehouse.

As shown in FIGS. 1A, 1B, 1D, and 1E, a main assembly valve 115 may be a dry-pipe or a preaction valve, and has an inlet 120 connected to the fire extinguishing fluid supply 105 via upstream piping 110*a*, and an outlet 125 connected to one or more sprinklers 145 via downstream piping 110*b*. The main assembly valve 115 prevents the fire extinguishing fluid from flowing through the outlet 125 (i.e., the main assembly valve 115 is closed) when the fire protection sprinkler system 100 is in an inactivated state, and permits the fire extinguishing fluid to flow through the inlet 120 and the outlet 125 (i.e., the main assembly valve 115 is open) when the fire protection sprinkler system 100 is in an activated state. That is, the main assembly valve 115 is configured to prevent the fire extinguishing fluid contained in the upstream piping 110*a* from passing through the inlet 120 and the outlet 125, and into the downstream piping 110*b*, until the sprinkler system 100 is activated. Prior to activation of the sprinkler system 100, pressurized fluid is permitted to flow from the pressurized fluid piping 110*c* to the downstream piping 110*b*, either directly or through the second inlet 130 of the main assembly valve 115, depending on the embodiment.

Figure 1B:
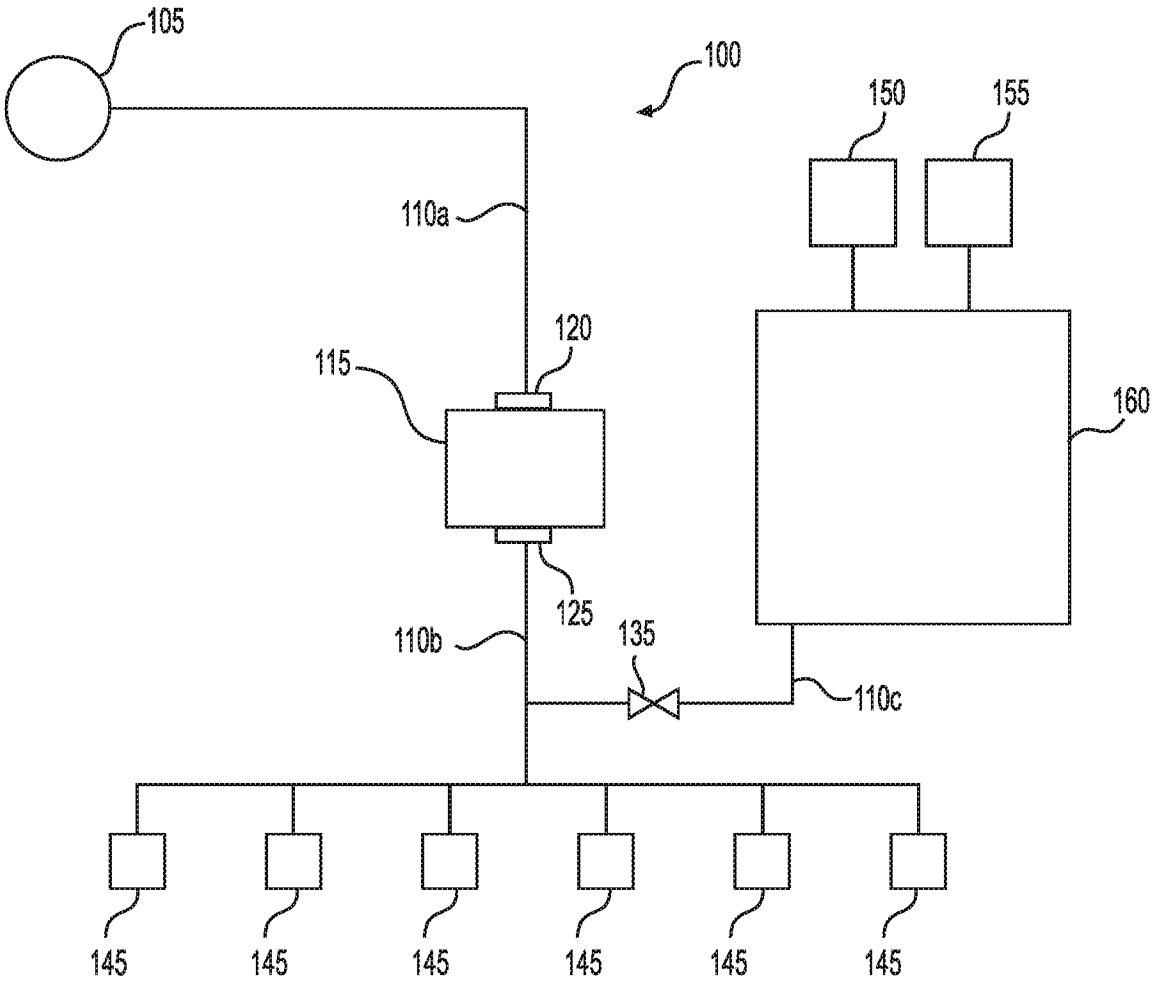
FIG. 1B is a schematic diagram illustrating a fire protection system, including a dry-pipe valve, of another embodiment of the invention including.
Figure 1C:
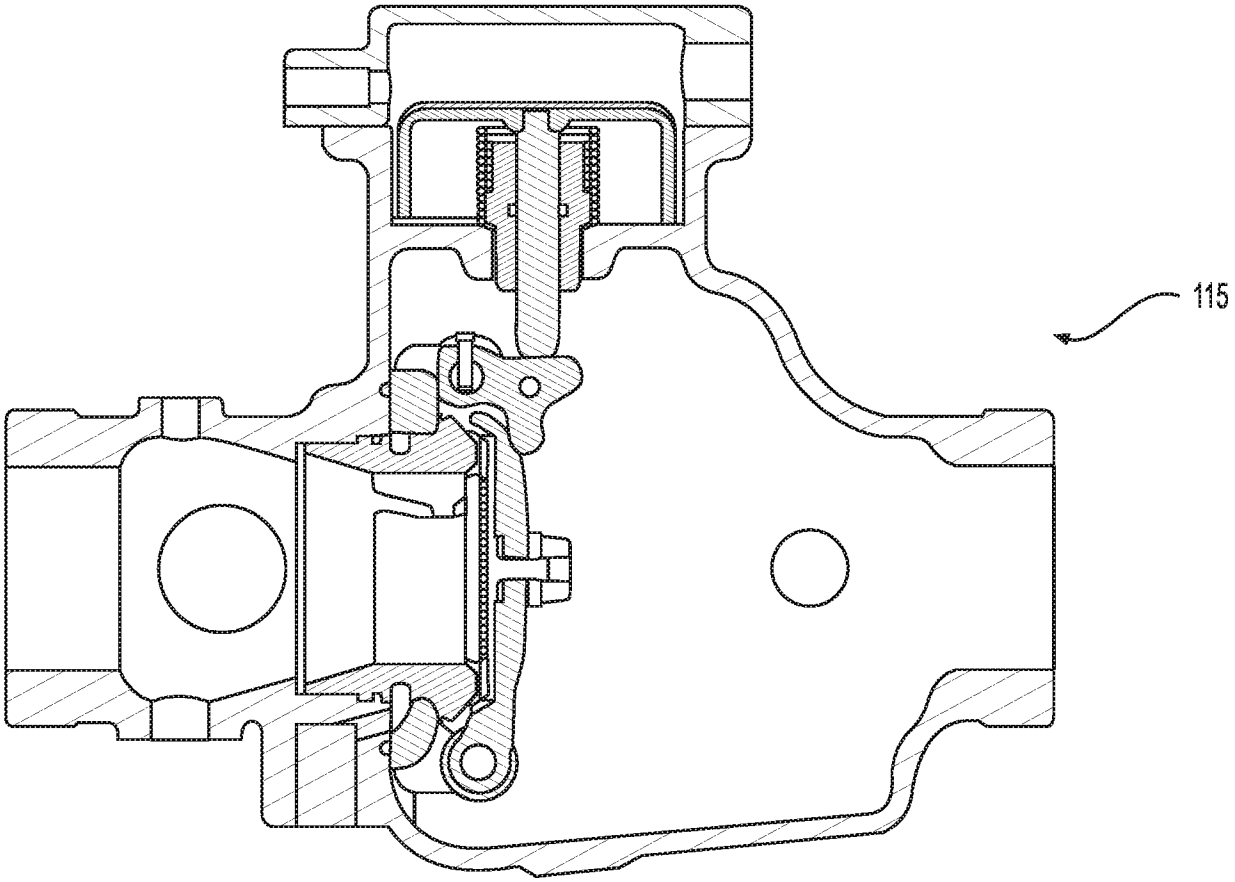
FIG. 1C is a detail view of a dry-pipe valve used in the fire protection system of some embodiments of the invention.

In FIGS. 1A and 1B, the main assembly valve 115 is a dry-pipe valve, shown in detail in FIG. 1C. FIG. 1A shows the dry-pipe valve 115 having a second inlet 130 connected to a pressure maintenance device 160 via pressurized fluid piping 110*c*. FIG. 1B shows the dry-pipe valve 115 without a second inlet 130, and instead, the pressurized fluid piping 110*c* connects directly to the downstream piping 110*b*. In the sprinkler system 100 including the dry-pipe valve 115, upon opening of an outlet of one or more of the sprinklers 145, the pressurized fluid in the downstream piping 110*b* escapes into the occupancy, and as a result of the drop in pressure of the pressurized fluid, the dry-pipe valve 115 opens to allow the fire extinguishing fluid to flow to the downstream piping and through the one or more sprinklers 145.

Figure 1D:
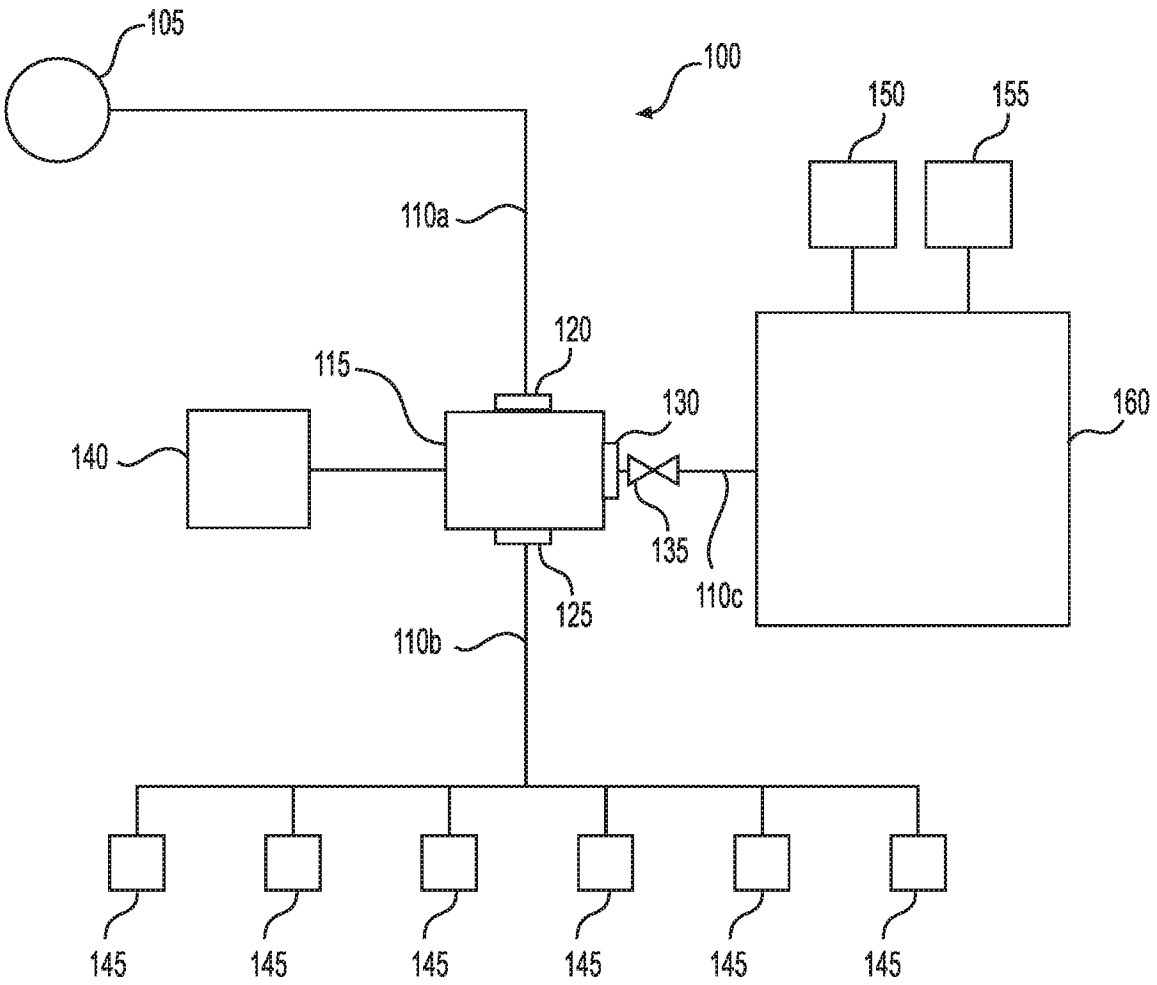
FIG. 1D is a schematic diagram illustrating a fire protection sprinkler system, including a preaction valve, of an embodiment of the invention.
Figure 1E:
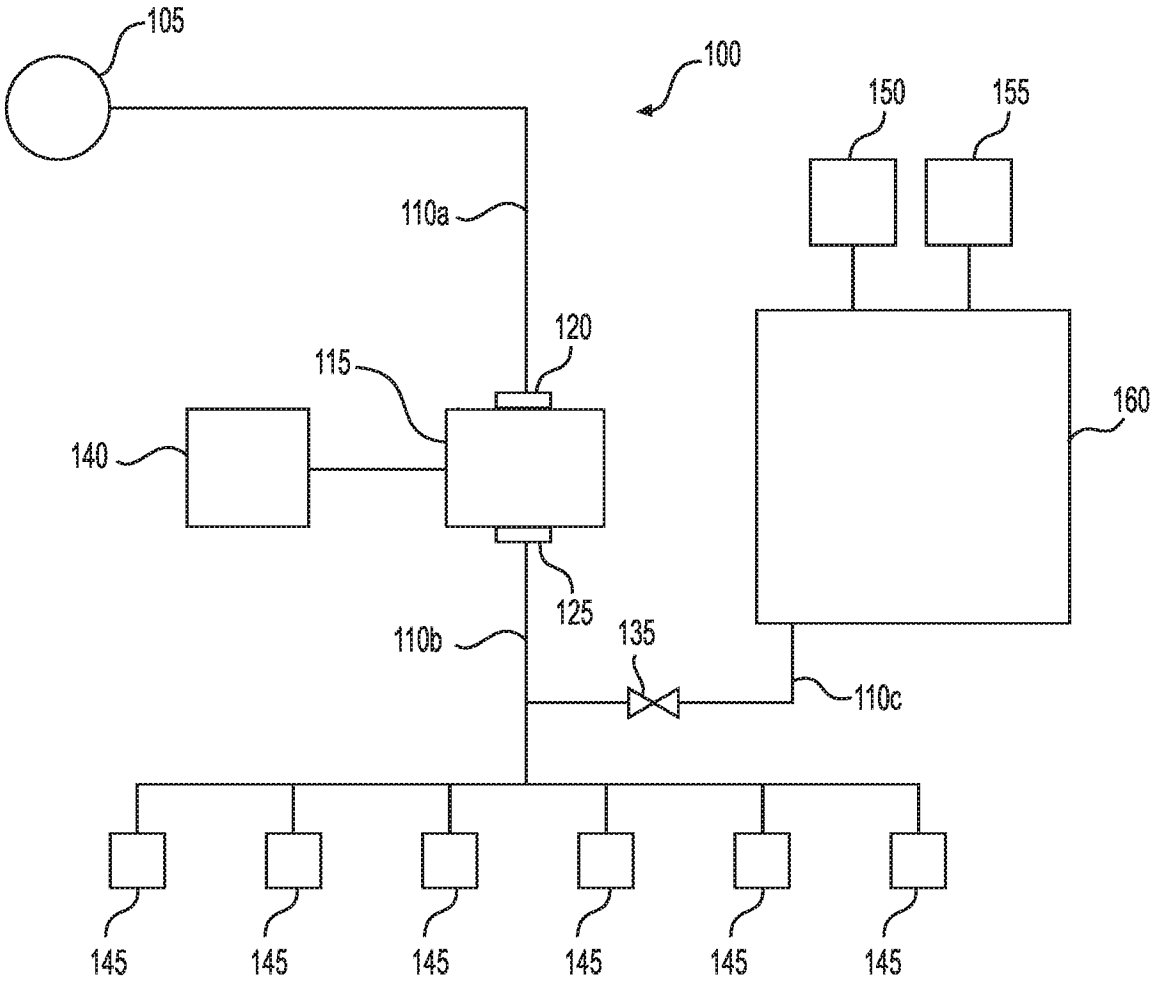
FIG. 1E is a schematic diagram illustrating a fire protection sprinkler system, including a preaction valve, of an embodiment of the invention.

In FIGS. 1D and 1E, the main assembly valve 115 is a preaction valve. In FIG. 1D, the preaction valve 115 has a second inlet 130 connected to a pressure maintenance device 160 via pressurized fluid piping 110*c*. In FIG. 1E, the preaction valve 115 does not have a second inlet 130, and instead, the pressurized fluid piping 110*c* connects directly to the downstream piping 110*b*. In both FIGS. 1D and 1E, the preaction valve 115 is connected to a fire detection unit 140. The fire detection unit 140 detects ambient temperature or smoke concentration in the occupancy. For example, the fire detection unit 140 may comprise a fixed temperature device configured to operate (i.e., to send a signal) when the detected ambient temperature reaches (i.e., is greater than or equal to) a predetermined temperature. While the detected temperature is less than the predetermined temperature, no signal is sent by the fire detection unit 140 to the preaction valve 115, and the preaction valve 115 remains closed.

When the detected temperature is equal to or greater than the predetermined temperature, the fire detection unit 140 sends a signal to the preaction valve 115, and the preaction valve 115 opens, allowing the fire extinguishing fluid to flow through the inlet 120 and the outlet 125 of the preaction valve 115, and the downstream piping 110*b*. The predetermined temperature T2 is set to a value within the range of 135° F. to 160° F. (57° C. to 74° C.). Alternatively, the fire detection unit 140 may be configured to detect a rate-of-rise of the ambient temperature, i.e., an abnormally fast temperature climb over a short time period. The fire detection unit 140 may alternatively be a spot-type detector (i.e., multiple fire detection units 140 are provided so as to be spaced along a ceiling or high on a wall). The fire detection unit 140 may also comprise a fixed temperature line-type detector, consisting of two cables surrounded by an insulative sheath, designed to breakdown (i.e., to melt) when exposed to heat. The fire detection units 140 may alternatively be smoke detectors, heat detectors, or a combination of heat detectors and smoke detectors.

The upstream piping 110*a*, the downstream piping 110*b*, and the pressurized fluid piping 110*c* may comprise black steel pipe, galvanized steel pipe, stainless steel tubing, or copper tubing, and may have threaded, grooved, or flanged connecting portions that permit attachment of the upstream piping 110*a*, downstream piping 110*b*, and pressurized fluid piping 110*c* to at least the fire extinguishing fluid supply 105, the dry-pipe or preaction valve 115, and the one or more sprinklers 145.

Figure 8:
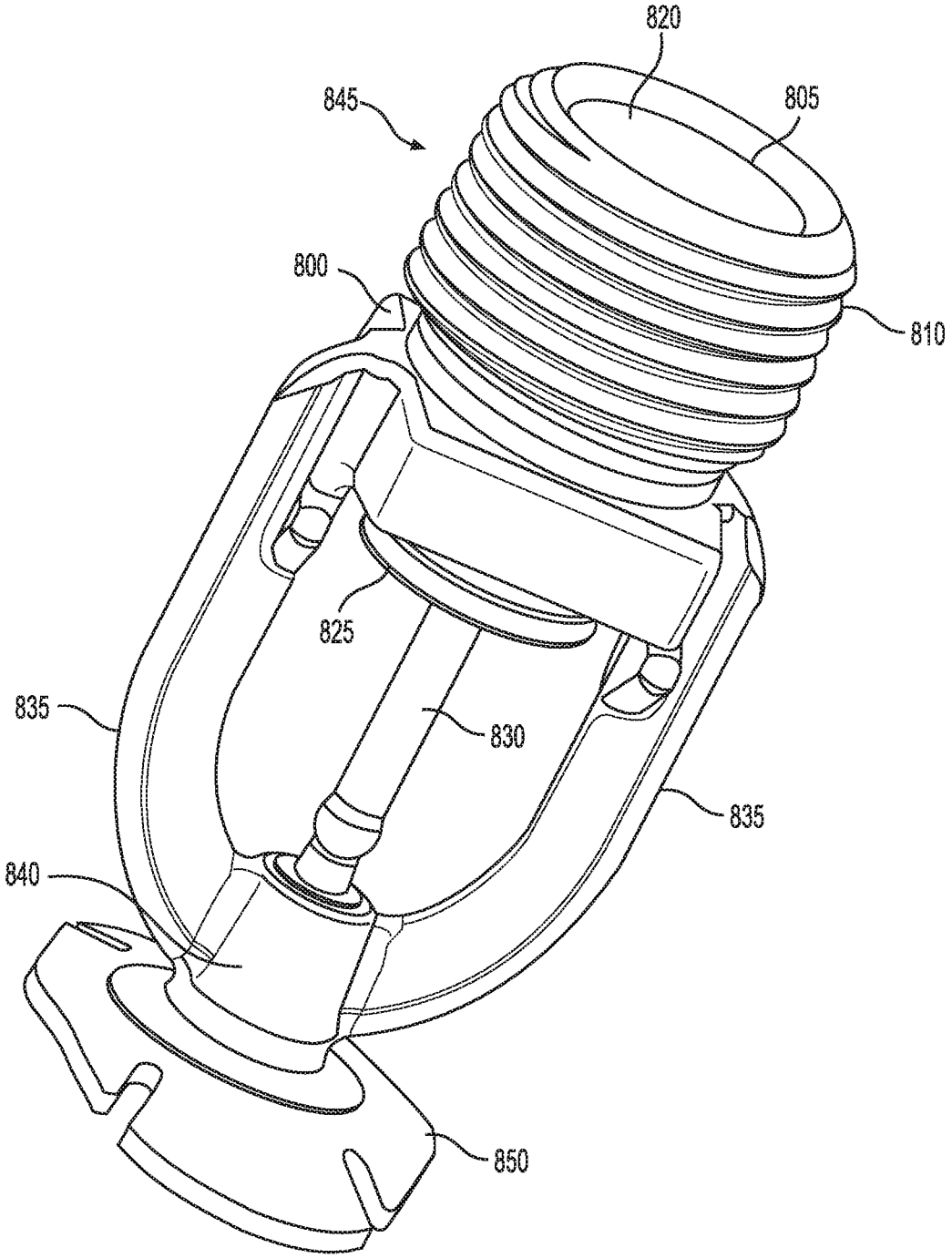
FIG. 8 is an isometric view of a sprinkler of a fire protection sprinkler system in an embodiment of the invention.

The downstream piping 110*b* may extend to several sprinklers 145 arranged throughout the occupancy, and connects each sprinkler 145 to the outlet 125 of the main assembly valve, as shown in FIGS. 1A, 1B, 1D, and 1E. As shown in FIG. 8, each fire protection sprinkler 845 includes a body 800 having an inlet 805 with a threaded surface of the inlet 810 configured to connect to the downstream piping 110*b*. The body 800 also has an outlet 815, and the inlet 805 and the outlet 815 define a fluid passage 820. At least one of the inlet 805 and the outlet 815 is sealed by a seal or a plug 825 that prevents flow of either the pressurized fluid or the fire extinguishing fluid through the sprinkler 845. The plug 825 is releasably supported by a thermally responsive element 830. As an example, the thermally responsive element 830 may be a frangible bulb, configured to break when ambient temperature near the sprinkler 845 reaches a certain temperature, such as a first predetermined temperature T1.

When the thermally responsive element 830 operates (i.e., fails) due to an elevated ambient temperature, the plug 825 is released, and the pressurized fluid or fire extinguishing fluid contained in the downstream piping 110*b* is permitted to flow from the outlet 815 of the sprinkler 845 into the occupancy. For example, when the sprinkler system 100 is in the activated state, fire extinguishing fluid, such as water, is supplied to the downstream piping 110*b* and to the sprinklers 845. In addition, the sprinkler 845 may include frame arms 835 extending from the body 800 and forming a hub or junction 840 downstream of the outlet 815. A deflector 850 may be mounted on the junction 840, and when the fire extinguishing fluid exits the outlet 815 of the sprinkler 845, droplets of the fire extinguishing fluid are deflected (i.e., redirected) by the deflector 850 in a spray pattern. The sprinkler 845 may be a pendent sprinkler or a horizontal sidewall sprinkler. The number of sprinklers 845 and the arrangement thereof within the occupancy is to be set in accordance with the standards set forth in Chapter 8 of the National Fire Protection Association Standard 13 ("NFPA 13"), published by the National Fire Protection Association, of Quincy, Mass., United States, and/or in Sections 2.1.3, 2.2.3, and 2.3.3 of FM Global Property Loss Prevention Data Sheet 2-0, published by FM Global, of Johnston, R.I., United States.

As shown in FIGS. 1A, 1B, 1D, and 1E, a first pressurized fluid supply 150 and a second pressurized fluid supply 155 are provided to supply the pressurized fluid to the pressurized fluid piping 110*c* and the downstream piping 110*b*. The pressurized fluid is preferably a fluid or a gas having a relatively low freezing point, for example, air or nitrogen. Examples of fluid supplies that may constitute one of or both of the first fluid supply 150 and the second fluid supply 155 include an air compressor, a nitrogen generator, a nitrogen tank, or a series of nitrogen tanks (i.e., a primary bank of nitrogen tanks and/or a secondary bank of nitrogen tanks). If a series of nitrogen tanks is used, a robotic device may be used to detach an empty nitrogen tank and to attach a filled nitrogen tank from the series of nitrogen tanks.

FIGS. 1A and 1D show the pressure maintenance device 160 being connected to each of the second inlet 130 of the main assembly valve 115 via the pressurized fluid piping 110*c*, the first pressurized fluid supply 150, and the second pressurized fluid supply 155.

Figure 2A:
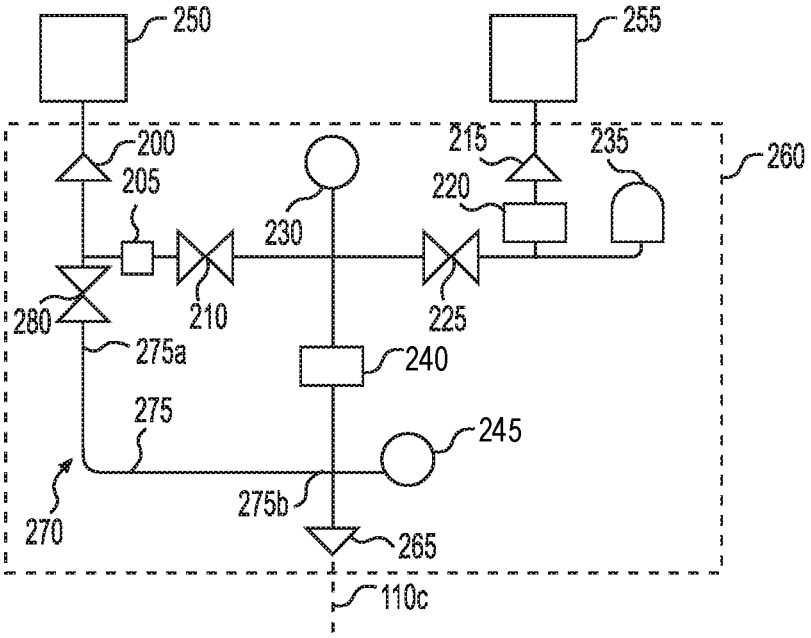
FIG. 2A is a schematic diagram of a pressure maintenance device used in an embodiment of the invention.

FIGS. 1B and 1E show the pressure maintenance device 160 being connected to each of the downstream piping 110*b* via the pressurized fluid piping 110*c*, the first pressurized fluid supply 150, and the second pressurized fluid supply 155. As shown in FIG. 2A, the pressure maintenance device 260 includes a first pressurized fluid inlet 200 configured to connect to at least the first pressurized fluid supply 250. A first pressure regulator 205, having a first pressure setting, is connected to at least the first pressurized fluid inlet 200, and is configured to regulate a pressure of the pressurized fluid supplied by the first pressurized fluid supply 250 through the first pressurized fluid inlet 200. The first pressure regulator 205 may be set to the first pressure setting to regulate the pressure of the supplied pressurized fluid to 100 psi. A first pressurized fluid valve 210 is connected to at least the first pressure regulator 205, and is configured to move between an open position and a closed position. As an alternative, the first pressurized fluid valve 210 may be a check valve configured to permit one-way fluid flow. The pressure maintenance device 260 also includes a second pressurized fluid inlet 215, configured to connect to at least the second pressurized fluid supply 255. A second pressure regulator 220, having a second pressure setting is connected to at least the second pressurized fluid inlet 215, and is configured to regulate a pressure of the pressurized fluid supplied by the second pressurized fluid supply 255 through the second pressurized fluid inlet 215. The second pressure regulator may be set to the second pressure setting to regulate the pressure of the supplied pressurized fluid to 80 psi. A second pressurized fluid valve 225 is connected to at least the second pressure regulator 220, and is configured to move between an open position and a closed position. As an alternative, the second pressurized fluid valve 225 may be a check valve configured to permit one-way fluid flow.

A supply pressurized fluid pressure sensor 230 is connected to at least the first pressurized fluid valve 210 and to the second pressurized fluid valve 225, and is configured to detect the pressure of the pressurized fluid supplied by one of the first pressurized fluid valve 210 and the second pressurized fluid valve 225. When the output of the supply pressurized fluid pressure sensor 230 indicates that the pressure of the pressurized fluid supplied by the first pressurized fluid supply 210 is less than the second pressure setting of the second pressure regulator 220, the pressure maintenance device 260 switches from a primary supply mode, in which the pressurized fluid is supplied by the first pressurized fluid supply 250, to a secondary supply mode, in which the pressurized fluid is supplied by the second pressurized fluid supply 255. Alternatively, in the embodiment shown in FIG. 2A, the supply pressurized fluid pressure sensor 230 may be configured to output the detected supply pressurized fluid pressure to a switch 235 that is connected to the second pressure regulator 220 and to the second pressurized fluid valve 225. In the embodiment shown in FIG. 2B, the switch 235 is connected to at least the first pressurized fluid valve 210, the second pressurized fluid valve 225, and the supply pressurized fluid pressure sensor 230.

The switch 235 is configured to receive the detected supply pressurized fluid pressure, and when the pressure maintenance device 260 is in a primary supply mode, the switch 230 is configured to permit supply of the pressurized fluid through the first pressurized fluid valve 210, and to prohibit supply of the pressurized fluid through the second pressurized fluid valve 225, such that the pressurized fluid is only supplied to the pressurized fluid piping 110*c* from the first fluid supply 250. When the pressure maintenance device 260 is in a secondary supply mode, the switch 235 is configured to permit supply of the pressurized fluid through the second pressurized fluid valve 225, and to prohibit supply of the pressurized fluid through the first pressurized fluid valve 210, such that the pressurized fluid is only supplied to the pressurized fluid piping 110*c* from the second fluid supply 255.

Figure 2B:
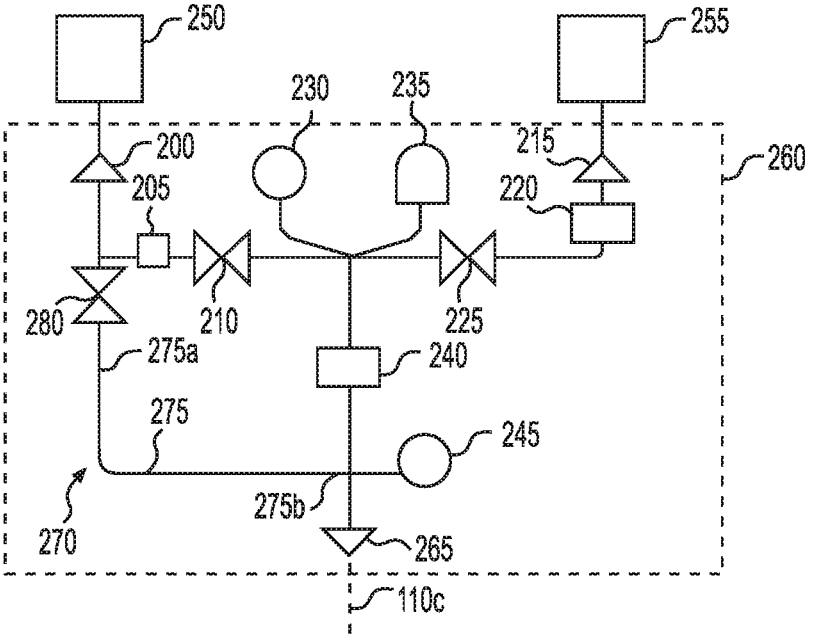
FIG. 2B is a schematic diagram of a pressure maintenance device used in another embodiment of the invention.
Figure 2C:
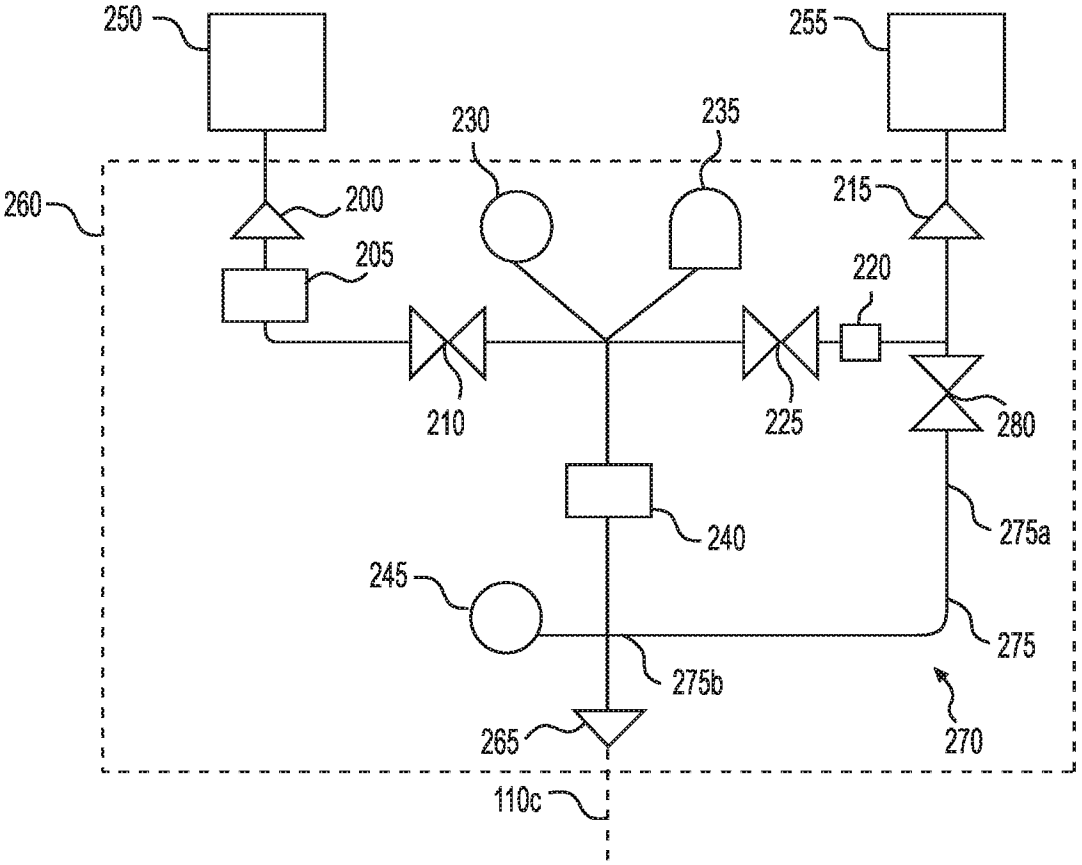
FIG. 2C is a schematic diagram of a pressure maintenance device used in yet another embodiment of the invention.
Figure 3:
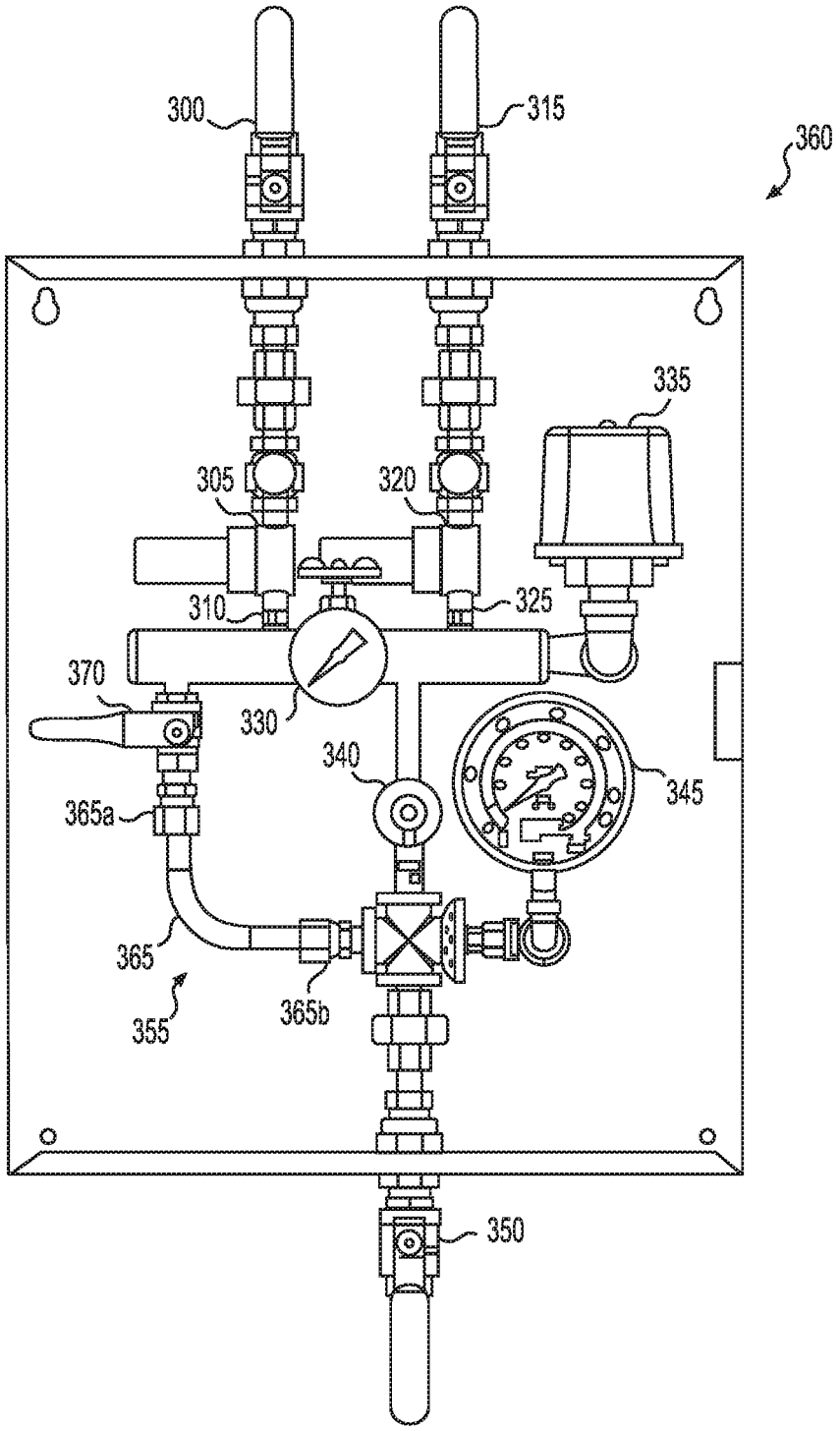
FIG. 3 is a side view of a pressure maintenance device used in an embodiment of the invention.
Figure 4:
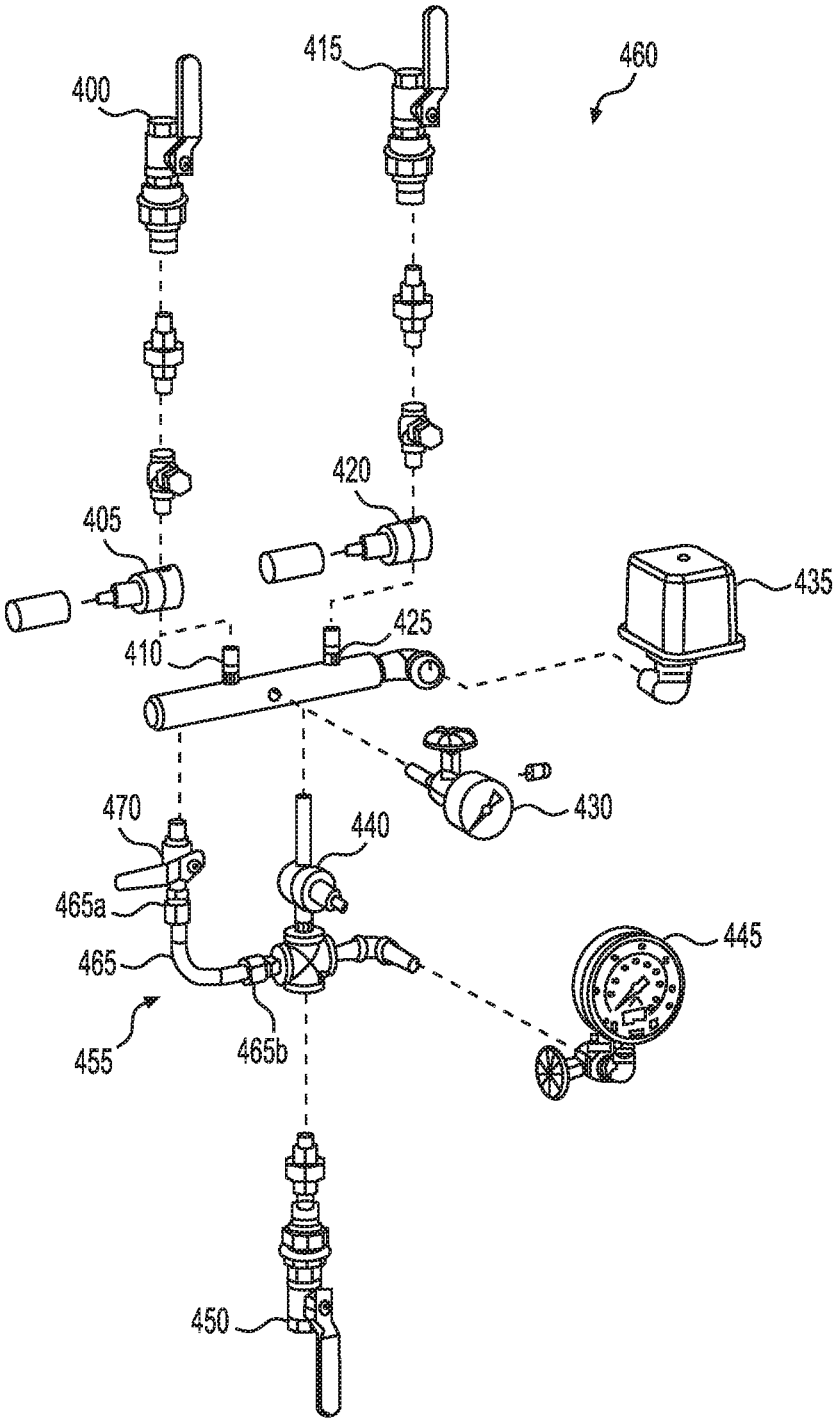
FIG. 4 is an exploded view of a pressure maintenance device used in an embodiment of the invention.
Figure 5:
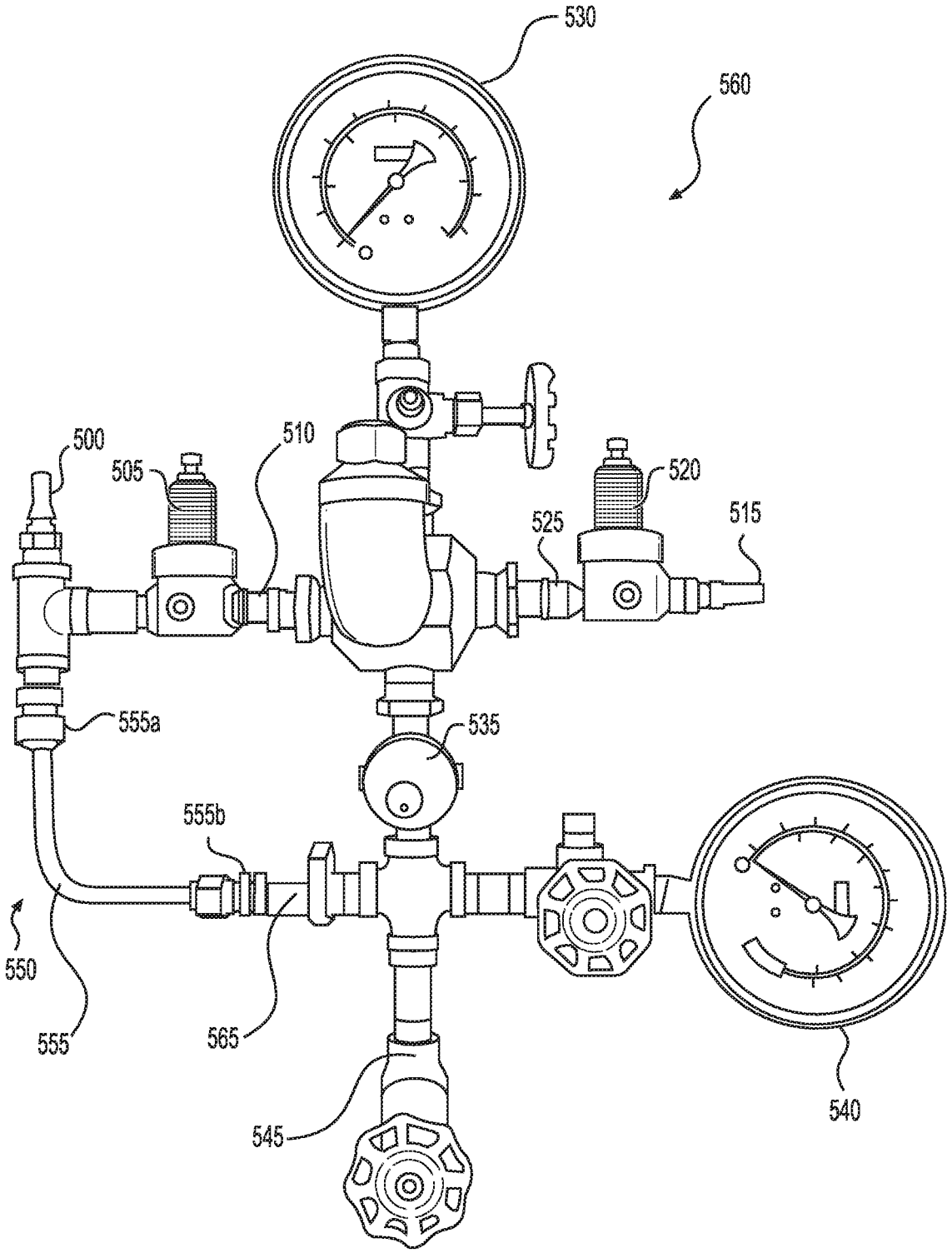
FIG. 5 is a side view of a pressure maintenance device used in an embodiment of the invention, without the switch.

FIGS. 2A and 2B show an outlet pressure regulator 240 that is connected to at least the first pressurized fluid valve 210, to the second pressurized fluid valve 225, to the supply pressurized fluid sensor 230, and to the switch 235. The outlet pressure regulator 240 is configured to regulate the pressure of the pressurized fluid downstream of each of the first pressurized fluid valve 210 and the second pressurized fluid valve 225. An outlet pressurized fluid pressure sensor 245 is connected to at least the outlet pressure regulator 240, and is configured to detect and to output an outlet pressurized fluid pressure. The outlet pressurized fluid pressure sensor 245 may, for example, output the detected outlet pressurized fluid pressure to the switch 235. A pressurized fluid outlet 265 is connected to at least the outlet pressure regulator 240, the outlet pressurized fluid pressure sensor 245, and the pressurized fluid piping 110*c*, as shown in FIGS. 2A-2C.

FIGS. 2A and 2B show a bypass unit 270, provided in the pressure maintenance device 260, and including a bypass line 275 having a first end 275*a* connected to the first pressurized fluid inlet 200, and a second end 275*b* connected to at least each of the outlet pressure regulator 240, the outlet pressurized fluid pressure sensor 245, and the pressurized fluid outlet 265. The bypass unit 270 also includes a bypass valve 280 provided at one of the first end 275*a* and the second end 275*b* of the bypass line 275. The bypass valve 280 is configured to move between an open position and a closed position. Although the bypass unit 270, as shown, connects to the first pressurized fluid inlet 200 at a first end thereof, in another embodiment of the invention, the bypass unit 270 may be connected to the second pressurized fluid inlet 215, as shown in FIG. 2C.

When the outlet pressurized fluid pressure detected by the outlet pressurized fluid pressure sensor 245 is greater than or equal to a first predetermined pressure P1, the supply pressurized fluid pressure detected by the supply pressurized fluid pressure sensor 230 is greater than or equal to a second predetermined pressure P2, and the bypass valve 280 is in the closed position, the pressure maintenance device 260 operates in the primary supply mode while the fire protection sprinkler system 100 is in the non-activated state. That is, the pressurized fluid is supplied from the first pressurized fluid supply 250 through the first pressurized fluid inlet 200, the first pressure regulator 205, the first pressurized fluid valve 210, and the outlet pressure regulator 240 to the pressurized fluid outlet 265. The switch 235 may indicate that the pressure maintenance device 260 is in the primary supply mode. When the outlet pressurized fluid pressure detected by the outlet pressurized fluid pressure sensor 245 is less than the first predetermined pressure P1, the supply pressurized fluid pressure detected by the supply pressurized fluid pressure sensor 230 is less than the second predetermined pressure P2, and the bypass valve 280 is in the closed position, the pressure maintenance device 260 automatically switches from the primary supply mode to the secondary supply mode, while the fire protection sprinkler system 100 is in the non-activated state. That is, the pressurized fluid is supplied from the second pressurized fluid supply 255 through the second pressurized fluid inlet 215, the second pressure regulator 220, the second pressure second pressurized fluid valve 225, and the outlet pressure regulator 240 to the pressurized fluid outlet 265. The switch 235 may indicate that the pressure maintenance device 260 is in the secondary supply mode.

In an embodiment that includes solenoid valves as the first pressurized fluid valve 210 and the second pressurized fluid valve 225, when the supply pressurized fluid pressure detected by the supply pressurized fluid pressure sensor 230 is less than the first predetermined pressure P1, the switch 235 may function to close the first pressurized fluid valve 210 and open the second pressurized fluid valve 225. Upon switching from the primary supply mode to the secondary supply mode, or, in the embodiment having solenoid valves, upon closing of the first pressurized fluid valve 210 and opening of the second pressurized fluid valve 225, the pressurized fluid is permitted to flow from the second pressurized fluid supply 255, through the second pressurized fluid inlet 215, the second pressure regulator 220, the second pressurized fluid valve 225, the outlet pressure regulator 240, and the pressurized fluid outlet 265. Alternatively, the switch 235 may only function to open the second pressurized fluid valve 225 without closing the first pressurized fluid valve 210.

When the bypass valve 280 is in the open position, the pressurized fluid is supplied from one of the first pressurized fluid supply 250 via the first pressurized fluid inlet 200, in the embodiments shown in FIGS. 1A and 2B, or from the second pressurized fluid supply 255 via the second pressurized fluid inlet 215, in the embodiment shown in FIG. 2C. In any of these embodiments, when the bypass valve 280 is in the open position, the pressurized fluid passes from the pressurized fluid supply 250, 255, through the bypass line 275, through the pressurized fluid outlet 265, so as to rapidly fill the piping, including the pressurized fluid piping 110*c* and the downstream piping 110*b*, with the pressurized fluid.

When the sprinkler system 100 is in the activated state, and the main assembly valve is open, a check valve 135 provided between the pressure maintenance device 160 and the main assembly valve 115 prevents fire extinguishing fluid from passing into the pressurized fluid piping 110*c* and the pressure maintenance device 160. The check valve 135 serves the purpose of preventing flooding of the pressure maintenance device 160 with the fire extinguishing fluid.

Figure 6:
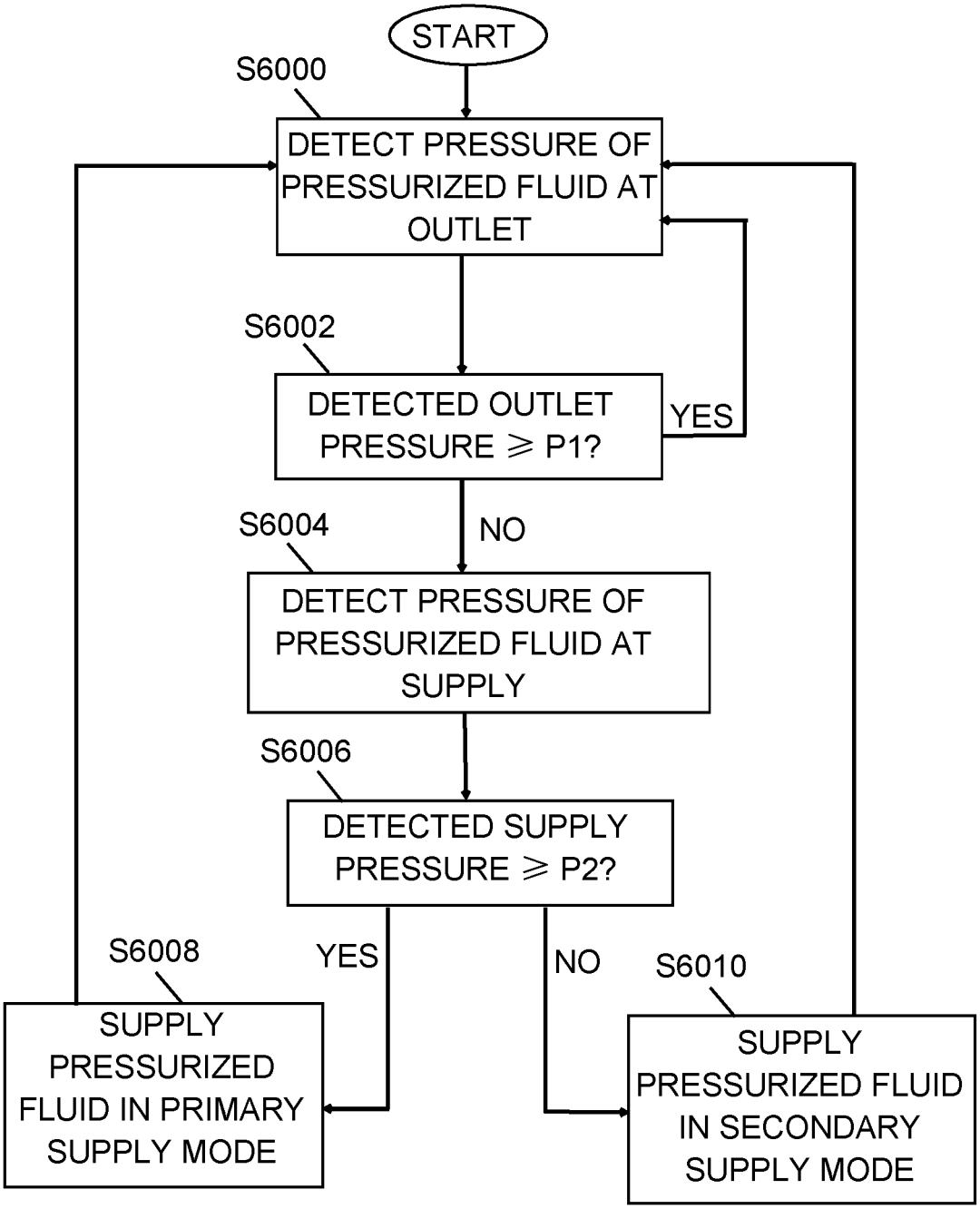
FIG. 6 is a flow chart depicting a method of using a pressure maintenance device according to an embodiment of the invention.

FIG. 6 shows a method implementing a pressure maintenance device 160 for maintaining a pressure of a pressurized fluid in downstream piping 110*b* and in pressurized fluid piping 110*c* of a fire protection sprinkler system 100. At the start of the method shown in FIG. 6, the main assembly valve 115 of the sprinkler system 100 is in a closed state when the sprinkler system 100 is in a non-activated state, preventing the fire extinguishing fluid from the fire extinguishing fluid supply 105 from passing through the main assembly valve 115 and entering the downstream piping 110*b*. In the non-activated state, the pressurized fluid is supplied by the pressure maintenance device 160 via the pressurized fluid supply piping 110*c* of the sprinkler system 100. In addition, the bypass valve 280 as part of a bypass unit 270 is in the closed position at the start of the method.

As shown in FIG. 6, the method comprises a step S6000 of detecting a pressure of the pressurized fluid downstream of the outlet pressure regulator using the outlet pressurized fluid pressure sensor 245. In step S6002, the detected pressure is compared to a first predetermined pressure P1, and, if the detected outlet pressure is greater than or equal to the first predetermined pressure P1, the process returns to step S6000. If the detected pressure is less than the first predetermined pressure P1, in step S6004, the supply pressurized fluid sensor 230 detects the pressure of the supplied pressurized fluid upstream of the outlet pressure regulator 240, and downstream of the first pressurized fluid valve 210. In step S6006, the supply pressure detected by the supply pressurized fluid sensor 230 is compared to a second predetermined pressure P2. If the detected supply pressure is greater than or equal to the second predetermined pressure P2, the pressure maintenance device 260 supplies the pressurized fluid from the first pressurized fluid supply 250 (i.e., the pressure maintenance device 260 supplies the pressurized fluid in a primary supply mode) in step S6008. Then, the process returns to step S6000.

If the detected supply pressure is less than the second predetermined pressure P2, the pressure maintenance device 260 supplies the pressurized fluid from the second pressurized fluid supply 255 (i.e., the pressure maintenance device 260 supplies the pressurized fluid in a secondary supply mode) in step S6010. Then, the process returns to step S6000. The second predetermined pressure P2 may be the set pressure of the second pressure regulator 220.

Figure 7:
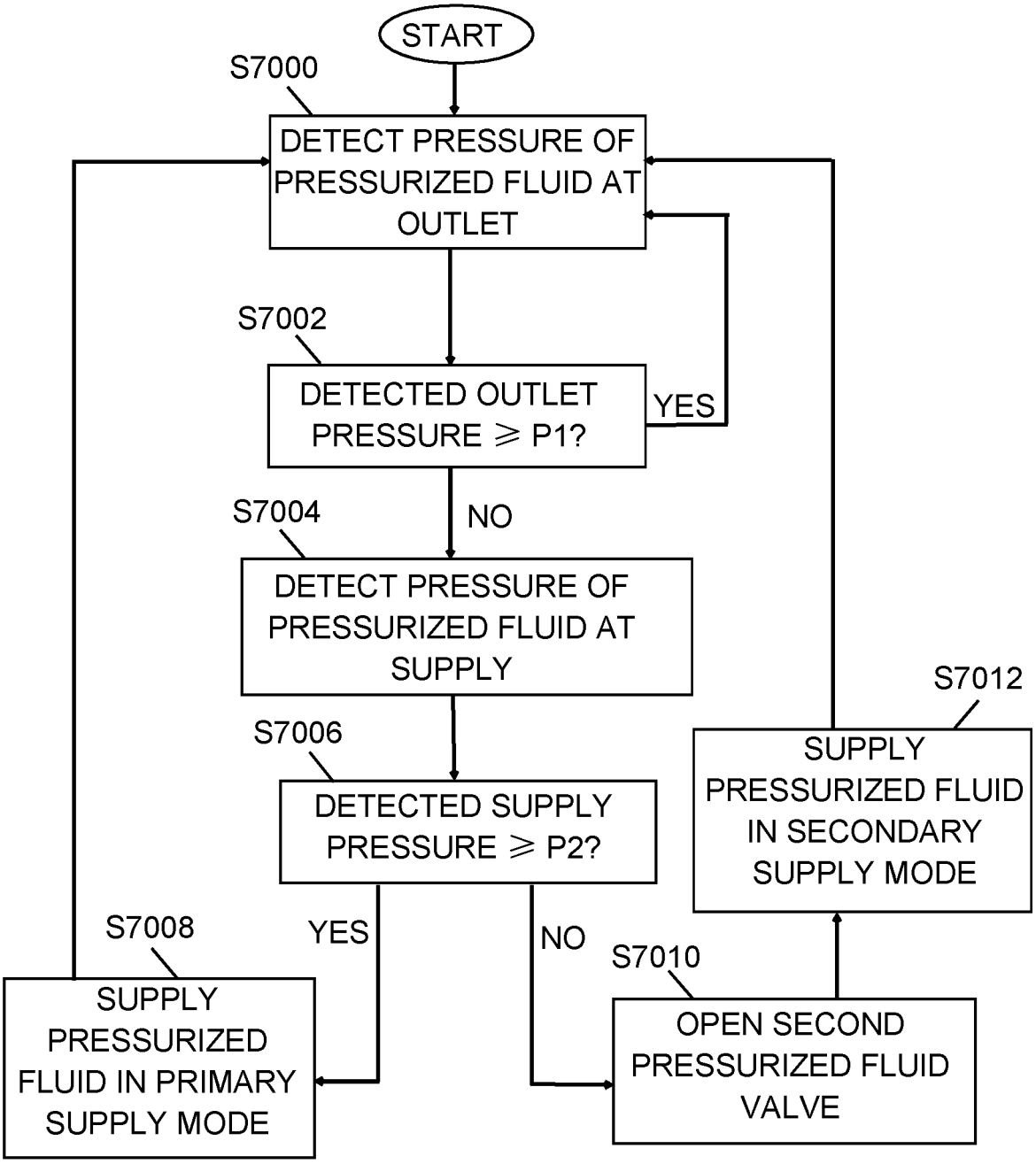
FIG. 7 is a flow chart depicting a method of using a pressure maintenance device according to an embodiment of the invention.

FIG. 7 shows a method implementing a pressure maintenance device 260 having a switch 235. At the start of the method of FIG. 7, the main assembly valve 115 of the sprinkler system 100 is in a closed state when the sprinkler system 100 is in a non-activated state, preventing the fire extinguishing fluid from the fire extinguishing fluid supply 105 from passing through the main assembly valve 115 and entering the downstream piping 110*b*. In the non-activated state, the pressurized fluid is supplied by the pressure maintenance device 160 via the pressurized fluid supply piping 110*c* of the sprinkler system 100. In addition, the bypass valve 280 as part of a bypass unit 270 is in the closed position at the start of the method.

As shown in FIG. 7, the method comprises a step S7000 of detecting a pressure of the pressurized fluid downstream of the outlet pressure regulator using the outlet pressurized fluid pressure sensor 245. In step S7002, the detected pressure is compared to a first predetermined pressure P1, and, if the detected outlet pressure is greater than or equal to the first predetermined pressure P1, the process returns to step S7000. If the detected pressure is less than the first predetermined pressure P1, in step S7004, the supply pressurized fluid sensor 230 detects the pressure of the supplied pressurized fluid upstream of the outlet pressure regulator 240, and downstream of the first pressurized fluid valve 210. In step S7006, the supply pressure detected by the supply pressurized fluid sensor 230 is compared to a second predetermined pressure P2. If the detected supply pressure is greater than or equal to the second predetermined pressure P2, the pressure maintenance device 260 supplies the pressurized fluid from the first pressurized fluid supply 250 (i.e., the pressure maintenance device 260 supplies the pressurized fluid in a primary supply mode) in step S7008. Then, the process returns to step S7000.

If the detected supply pressure is less than the second predetermined pressure P2, the switch 235 of the pressure maintenance device 260 switches at least the second pressurized fluid valve 225 that may be a solenoid valve, in step S7010. Then, in step S7012, the pressure maintenance device 260 supplies the pressurized fluid from the second pressurized fluid supply 255 (i.e., the pressure maintenance device 260 supplies the pressurized fluid in a secondary supply mode). Then, the process returns to step S7000. The second predetermined pressure P2 may be the set pressure of the second pressure regulator 220.

In another embodiment, in addition to opening the second pressurized fluid valve 225, the switch 235 may operate to close the first pressurized fluid valve 210 that may also be a solenoid valve.

In both of the methods shown in FIGS. 6 and 7, if the bypass valve 280 is switched from the closed state to the opened state, the pressurized fluid flows from the first pressurized fluid supply 250 (for the embodiments shown in FIGS. 2A and 2B) or from the second pressurized fluid supply 255 (for the embodiment shown in FIG. 2C), in order to rapidly pressurized the pressurized fluid piping 110*c* and the downstream piping 110*b* following maintenance or testing of the sprinkler system 100.

By virtue of the above-described invention, when an inadvertent loss of pressure occurs in a fire protection sprinkler system, due to a leak in the sprinkler system or due to depletion of a first pressurized fluid supply, supply of the pressurized fluid is automatically switched from the first pressurized fluid supply to a second pressurized fluid when the sprinkler system is in the non-activated state.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

We claim:

1. A fire protection sprinkler system comprising:

(A) a fire extinguishing fluid supply that supplies a fire extinguishing fluid to the sprinkler system;

(B) piping connected to the fire extinguishing fluid supply, and including an upstream portion, a downstream portion, and a pressurized fluid supply portion;

(C) a three-way valve having:

(a) a first inlet connected to the fire extinguishing fluid supply via the upstream portion of the piping, and being configured to open and to close;

(b) a second inlet connected to the pressurized fluid supply portion of the piping, and being configured to open and to close; and (c) an outlet connected to the downstream portion of the piping;

(D) a fire detection unit connected to the three-way valve, and configured to detect ambient temperature, the fire detection unit sending a signal to the three-way valve to cause the three-way valve to open the first inlet and to close the second inlet;

(E) at least one fire protection sprinkler connected to the outlet of the three-way valve via the downstream portion of the piping, and configured to open when the ambient temperature reaches a sprinkler activation temperature;

(F) a first pressurized fluid supply that supplies a pressurized fluid to the pressurized fluid supply portion of the piping;

(G) a second pressurized fluid supply that supplies the pressurized fluid to the pressurized fluid supply portion of the piping; and (H) a pressure maintenance device connected to each of the second inlet of the three-way valve, the first pressurized fluid supply, and the second pressurized fluid supply, the pressure maintenance device including:

(a) a first pressurized fluid unit having:
  (i) a first inlet that receives a pressurized fluid from the first pressurized fluid supply;
  (ii) a first pressure regulator connected to the first inlet, and configured to regulate a pressure of the pressurized fluid received through the first inlet; and
  (iii) a first valve connected to at least the first pressure regulator, and configured to open and to close;

(b) a second pressurized fluid unit having:
  (i) a second inlet that receives the pressurized fluid from the second pressurized fluid supply;
  (ii) a second pressure regulator connected to at least the second inlet, and configured to regulate a pressure of the pressurized fluid received through the second inlet; and
  (iii) a second valve connected to at least the second pressure regulator, and configured to open and to close;

(c) a supply pressure sensor connected to at least the first pressurized fluid unit and to the second pressurized fluid unit, and configured to detect the pressure of the pressurized fluid supplied by one of the first pressurized fluid unit and the second pressurized fluid unit;

(d) a switch connected to at least the first pressurized fluid unit, the second pressurized fluid unit, and the supply pressure sensor, and configured to automatically switch from a primary supply mode, in which the pressurized fluid is supplied through the first pressurized fluid unit, and a secondary supply mode, in which the pressurized fluid is supplied through the second pressurized fluid unit, based on the detected supply pressurized fluid pressure;

(e) a pressurized fluid outlet unit having:
  (i) an outlet pressure regulator connected to at least the first pressure regulator, the second pressure regulator, the supply pressure sensor, and the switch, and configured to regulate the pressure of the pressurized fluid downstream of each of the first pressure regulator and the second pressure regulator;
  (ii) an outlet pressure sensor connected to at least the outlet pressure regulator, and configured to detect an outlet pressurized fluid pressure, and to output the detected outlet pressurized fluid pressure to the switch; and
  (iii) an outlet connected to at least the outlet pressure regulator, the outlet pressure sensor, and the second inlet of the three-way valve via the pressurized fluid supply portion of the piping, and configured to output the pressurized fluid from the pressure maintenance device; and (f) a bypass unit connected to the pressurized fluid outlet unit and to one of the first pressurized fluid unit and the second pressurized fluid unit, and configured to bypass the corresponding one of the first valve and the second valve to supply the pressurized fluid to the outlet, and configured to open and to close, the bypass unit including: (i) a bypass line having a first end connected to the corresponding one of the first pressure regulator and the second pressure regulator, and a second end connected to at least each of the outlet pressure regulator, the outlet pressure sensor, and the outlet, and (ii) a bypass valve provided at one of the first end and the second end of the bypass line, the bypass valve configured to open and to close, wherein the bypass valve is closed when the pressure maintenance device is in one of the primary supply mode and the secondary supply mode, wherein, when the detected outlet pressurized fluid pressure is greater than or equal to a predetermined outlet pressure and the detected supply pressurized fluid pressure is greater than or equal to a predetermined supply pressure, the switch operates to maintain the pressure maintenance device in the primary supply mode while the sprinkler system is in a non-activated state, wherein, when the detected outlet pressurized fluid pressure is greater than or equal to the predetermined outlet pressure and the detected supply pressurized fluid pressure is less than the predetermined supply pressure, the switch operates to switch from the primary supply mode to the secondary supply mode, while the sprinkler system is in the non-activated state, and wherein, when the bypass valve is opened, the pressurized fluid is supplied from the one of the first pressure regulator and the second pressure regulator connected to the bypass line at the first end, so as to rapidly fill the pressurized fluid supply portion and the downstream portion of the piping with the pressurized fluid when the pressure maintenance device is in a bypass mode and the sprinkler system is in the non-activated state.

2. The fire protection sprinkler system according to claim 1, wherein the switch operates to switch from one of the primary supply mode and the secondary supply mode to a non-supply mode, in which the pressurized fluid outlet unit does not output the pressurized fluid, each of the first pressurized fluid valve, the second pressurized fluid valve, and the bypass valve is closed, and the fire extinguishing fluid is permitted to flow from the fire extinguishing fluid supply to the at least one fire protection sprinkler through the upstream portion of the piping, the three-way valve, and the downstream portion of the piping when the sprinkler system is in an activated state.

3. The fire protection sprinkler system according to claim 2, wherein the sprinkler system switches from the non-activated state to the activated state when the at least one fire protection sprinkler opens.

4. The fire protection sprinkler system according to claim 1, wherein the three-way valve is one of a dry-pipe valve and a preaction valve.

5. The fire protection sprinkler system according to claim 1, wherein the pressurized fluid is one of air and nitrogen.

6. The fire protection sprinkler system according to claim 1, wherein at least one of the first pressurized fluid supply and the second pressurized fluid supply is one of an air compressor, a nitrogen generator, a nitrogen tank, and a series of nitrogen tanks.

7. The fire protection sprinkler system according to claim 1, wherein the fire detection unit sends the signal to the three-way valve when the detected temperature is equal to or greater than a predetermined temperature.

8. The fire protection sprinkler system according to claim 7, wherein the predetermined temperature is in the range of 135° F. to 160° F., inclusive.

9. The fire protection sprinkler system according to claim 1, wherein the fire detection unit sends the signal to the three-way valve when a rate-of-rise of the detected temperature reaches a predetermined rate.

10. The fire protection sprinkler system according to claim 1, wherein the fire detection unit is at least one of a smoke detector and a heat detector.

11. A method of controlling supply of a pressurized fluid and a fire extinguishing fluid to a fire protection sprinkler system using a pressure maintenance device, the method comprising:

(A) providing the fire protection sprinkler system that comprises:

(a) a fire extinguishing fluid supply that supplies the fire extinguishing fluid to the sprinkler system;

(b) piping connected to the fire extinguishing fluid supply, and including an upstream portion, a downstream portion, and a pressurized fluid supply portion;

(c) a three-way valve having:

(i) a first inlet connected to the fire extinguishing fluid supply via the upstream portion of the piping, and being configured to open and to close;

(ii) a second inlet connected to the pressurized fluid supply portion of the piping, and being configured to open and to close;

(i) an outlet connected to the downstream portion of the piping;

(d) a fire detection unit connected to the three-way valve, and configured to detect ambient temperature, the fire detection unit sending a signal to the three-way valve to cause the three-way valve to open the first inlet and to close the second inlet;

(e) at least one fire protection sprinkler connected to the outlet of the three-way valve via the downstream portion of the piping, and configured to open when the ambient temperature reaches a sprinkler activation temperature;

(f) a first pressurized fluid supply that supplies a pressurized fluid to the pressurized fluid supply portion of the piping;

(g) a second pressurized fluid supply that supplies the pressurized fluid to the pressurized fluid supply portion of the piping; and (h) a pressure maintenance device connected to each of the second inlet of the three-way valve, the first pressurized fluid supply, and the second pressurized fluid supply, the pressure maintenance device including:

(i) a first pressurized fluid unit having:

(1) a first inlet that receives a pressurized fluid from the first pressurized fluid supply;

(2) a first pressure regulator connected to the first inlet, and configured to regulate a pressure of the pressurized fluid received through the first inlet; and (3) a first valve connected to at least the first pressure regulator, and configured to open and to close;

(ii) a second pressurized fluid unit having:

(1) a second inlet that receives the pressurized fluid from the second pressurized fluid supply;

(2) a second pressure regulator connected to at least the second inlet, and configured to regulate a pressure of the pressurized fluid received through the second inlet; and (3) a second valve connected to at least the second pressure regulator, and configured to open and to close;

(iii) a supply pressure sensor connected to at least the first pressurized fluid unit and to the second pressurized fluid unit, and configured to detect the pressure of the pressurized fluid supplied by one of the first pressurized fluid unit and the second pressurized fluid unit;

(iv) a switch connected to at least the first pressurized fluid unit, the second pressurized fluid unit, and the supply pressure sensor, and configured to automatically switch from a primary supply mode, in which the pressurized fluid is supplied through the first pressurized fluid unit, and a secondary supply mode, in which the pressurized fluid is supplied through the second pressurized fluid unit, based on the detected supply pressurized fluid pressure;

(v) a pressurized fluid outlet unit having:

(1) an outlet pressure regulator connected to at least the first pressure regulator, the second pressure regulator, the supply pressure sensor, and the switch, and configured to regulate the pressure of the pressurized fluid downstream of each of the first pressure regulator and the second pressure regulator;

(2) an outlet pressure sensor connected to at least the outlet pressure regulator, and configured to detect an outlet pressurized fluid pressure, and to output the detected outlet pressurized fluid pressure to the switch; and (3) an outlet connected to at least the outlet pressure regulator, the outlet pressure sensor, and the second inlet of the three-way valve via the pressurized fluid supply portion of the piping, and configured to output the pressurized fluid from the pressure maintenance device; and (vi) a bypass unit connected to the pressurized fluid outlet unit and to one of the first pressurized fluid unit and the second pressurized fluid unit, and configured to bypass the corresponding one of the first valve and the second valve to supply the pressurized fluid to the outlet, and configured to open and to close, the bypass unit including (1) a bypass line having a first end connected to the corresponding one of the first pressure regulator and the second pressure regulator, and a second end connected to at least each of the outlet pressure regulator, the outlet pressure sensor, and the outlet, and (2) a bypass valve provided at one of the first end and the second end of the bypass line, the bypass valve configured to open and to close;

(B) operating the switch, when the detected outlet pressurized fluid pressure is greater than or equal to a predetermined outlet pressure and the detected supply pressurized fluid pressure is greater than or equal to a predetermined supply pressure, to maintain the pressure maintenance device in the primary supply mode while the sprinkler system is in a non-activated state;

(C) operating the switch, when the detected outlet pressurized fluid pressure is greater than or equal to the predetermined outlet pressure and the detected supply pressurized fluid pressure is less than the predetermined supply pressure, to switch from the primary supply mode to the secondary supply mode, while the sprinkler system is in the non-activated state;

(D) closing the bypass valve when the pressure maintenance device is in one of the primary supply mode and the secondary supply mode; and (E) opening the bypass valve to supply the pressurized fluid from the one of the first pressure regulator and the second pressure regulator connected to the bypass line at the first end, so as to rapidly fill the pressurized fluid supply portion and the downstream portion of the piping with the pressurized fluid when the pressure maintenance device is in a bypass mode and the sprinkler system is in the non-activated state.

12. The method according to claim 11, further comprising (F) operating the switch to switch from one of the primary supply mode and the second supply mode to a non-supply mode, in which the pressurized fluid outlet unit does not output the pressurized fluid, each of the first pressurized fluid valve, the second pressurized fluid valve, and the bypass valve is closed, and the fire extinguishing fluid is permitted to flow from the fire extinguishing fluid supply to the at least one fire protection sprinkler through the upstream portion of the piping, the three-way valve, and the downstream portion of the piping when the sprinkler system is in an activated state.

13. The method according to claim 12, wherein the sprinkler system switches from the non-activated state to the activated state when the at least one fire protection sprinkler opens.

14. The method according to claim 11, wherein the three-way valve is one of a dry-pipe valve and a preaction valve.

15. The method according to claim 11, wherein the pressurized fluid is one of air and nitrogen.

16. The method according to claim 11, wherein at least one of the first pressurized fluid supply and the second pressurized fluid supply is one of an air compressor, a nitrogen generator, a nitrogen tank, and a series of nitrogen tanks.

17. The method according to claim 11, wherein the fire detection unit sends the signal to the three-way valve when the detected temperature is equal to or greater than a predetermined temperature.

18. The method according to claim 17, wherein the predetermined temperature is in the range of 135° F. to 160° F., inclusive.

19. The method according to claim 11, wherein the fire detection unit sends the signal to the three-way valve when a rate-of-rise of the detected temperature reaches a predetermined rate.

20. The method according to claim 11, wherein the fire detection unit is at least one of a smoke detector and a heat detector.

21. A fire protection sprinkler system comprising:

(A) a fire extinguishing fluid supply that supplies a fire extinguishing fluid to the sprinkler system;

(B) piping connected to the fire extinguishing fluid supply, and including an upstream portion, a downstream portion, and a pressurized fluid supply portion;

(C) a three-way valve having:

(a) a first inlet connected to the fire extinguishing fluid supply via the upstream portion of the piping, and being configured to open and to close;

(b) a second inlet connected to the pressurized fluid supply portion of the piping, and being configured to open and to close; and (c) an outlet connected to the downstream portion of the piping;

(D) a fire detection unit connected to the three-way valve, and configured to detect ambient temperature, the fire detection unit sending a signal to the three-way valve to cause the three-way valve to open the first inlet and to close the second inlet;

(E) at least one fire protection sprinkler connected to the outlet of the three-way valve via the downstream portion of the piping, and configured to open when the ambient temperature reaches a sprinkler activation temperature;

(F) a first pressurized fluid supply that supplies a pressurized fluid to the pressurized fluid supply portion of the piping;

(G) a second pressurized fluid supply that supplies the pressurized fluid to the pressurized fluid supply portion of the piping; and (H) a pressure maintenance device connected to each of the second inlet of the three-way valve, the first pressurized fluid supply, and the second pressurized fluid supply, the pressure maintenance device including:

(a) a first pressurized fluid unit having:

(i) a first inlet that receives a pressurized fluid from the first pressurized fluid supply;

(ii) a first pressure regulator connected to the first inlet, and configured to regulate a pressure of the pressurized fluid received through the first inlet; and (iii) a first valve connected to at least the first pressure regulator, and configured to open and to close;

(b) a second pressurized fluid unit having:

(i) a second inlet that receives the pressurized fluid from the second pressurized fluid supply;

(ii) a second pressure regulator connected to at least the second inlet, and configured to regulate a pressure of the pressurized fluid received through the second inlet; and (iii) a second valve connected to at least the second pressure regulator, and configured to open and to close;

(c) a supply pressure sensor connected to at least the first pressurized fluid unit and to the second pressurized fluid unit, and configured to detect the pressure of the pressurized fluid supplied by one of the first pressurized fluid unit and the second pressurized fluid unit;

(d) a switch connected to at least the first pressurized fluid unit, the second pressurized fluid unit, and the supply pressure sensor, and configured to automatically switch from a primary supply mode, in which the pressurized fluid is supplied through the first pressurized fluid unit, and a secondary supply mode, in which the pressurized fluid is supplied through the second pressurized fluid unit, based on the detected supply pressurized fluid pressure;

(e) a pressurized fluid outlet unit having:

(i) an outlet pressure regulator connected to at least the first pressure regulator, the second pressure regulator, the supply pressure sensor, and the switch, and configured to regulate the pressure of the pressurized fluid downstream of each of the first pressure regulator and the second pressure regulator;

(ii) an outlet pressure sensor connected to at least the outlet pressure regulator, and configured to detect an outlet pressurized fluid pressure, and to output the detected outlet pressurized fluid pressure to the switch; and (iii) an outlet connected to at least the outlet pressure regulator, the outlet pressure sensor, and the second inlet of the three-way valve via the pressurized fluid supply portion of the piping, and configured to output the pressurized fluid from the pressure maintenance device; and (f) a bypass unit connected to the pressurized fluid outlet unit and to one of the first pressurized fluid unit and the second pressurized fluid unit, and configured to bypass the corresponding one of the first valve and the second valve to supply the pressurized fluid to the outlet, and configured to open and to close, wherein, when the detected outlet pressurized fluid pressure is greater than or equal to a predetermined outlet pressure and the detected supply pressurized fluid pressure is greater than or equal to a predetermined supply pressure, the switch operates to maintain the pressure maintenance device in the primary supply mode while the sprinkler system is in a non-activated state, wherein, when the detected outlet pressurized fluid pressure is greater than or equal to the predetermined outlet pressure and the detected supply pressurized fluid pressure is less than the predetermined supply pressure, the switch operates to switch from the primary supply mode to the secondary supply mode, while the sprinkler system is in the non-activated state, wherein the switch operates to switch from one of the primary supply mode and the secondary supply mode to a non-supply mode, in which the pressurized fluid outlet unit does not output the pressurized fluid, each of the first pressurized fluid valve, the second pressurized fluid valve, and the bypass valve is closed, and the fire extinguishing fluid is permitted to flow from the fire extinguishing fluid supply to the at least one fire protection sprinkler through the upstream portion of the piping, the three-way valve, and the downstream portion of the piping when the sprinkler system is in an activated state, and wherein the sprinkler system switches from the non-activated state to the activated state when the at least one fire protection sprinkler opens.

22. The fire protection sprinkler system according to claim 21, wherein the bypass unit includes:

(i) a bypass line having a first end connected to the corresponding one of the first pressure regulator and the second pressure regulator, and a second end connected to at least each of the outlet pressure regulator, the outlet pressure sensor, and the outlet; and (ii) a bypass valve provided at one of the first end and the second end of the bypass line, the bypass valve configured to open and to close.

23. The fire protection sprinkler system according to claim 22, wherein the bypass valve is closed when the pressure maintenance device is in one of the primary supply mode and the secondary supply mode.

24. The fire protection sprinkler system according to claim 23, wherein, when the bypass valve is opened, the pressurized fluid is supplied from the one of the first pressure regulator and the second pressure regulator connected to the bypass line at the first end, so as to rapidly fill the pressurized fluid supply portion and the downstream portion of the piping with the pressurized fluid when the pressure maintenance device is in a bypass mode and the sprinkler system is in the non-activated state.

25. The fire protection sprinkler system according to claim 21, wherein the three-way valve is one of a dry-pipe valve and a preaction valve.

26. The fire protection sprinkler system according to claim 21, wherein the pressurized fluid is one of air and nitrogen.

27. The fire protection sprinkler system according to claim 21, wherein at least one of the first pressurized fluid supply and the second pressurized fluid supply is one of an air compressor, a nitrogen generator, a nitrogen tank, and a series of nitrogen tanks.

28. The fire protection sprinkler system according to claim 21, wherein the fire detection unit sends the signal to the three-way valve when the detected temperature is equal to or greater than a predetermined temperature.

29. The fire protection sprinkler system according to claim 28, wherein the predetermined temperature is in the range of 135° F. to 160° F., inclusive.

30. The fire protection sprinkler system according to claim 21, wherein the fire detection unit sends the signal to the three-way valve when a rate-of-rise of the detected temperature reaches a predetermined rate.

31. The fire protection sprinkler system according to claim 21, wherein the fire detection unit is at least one of a smoke detector and a heat detector.

32. A method of controlling supply of a pressurized fluid and a fire extinguishing fluid to a fire protection sprinkler system using a pressure maintenance device, the method comprising:

(A) providing the fire protection sprinkler system that comprises:

(a) a fire extinguishing fluid supply that supplies the fire extinguishing fluid to the sprinkler system;

(b) piping connected to the fire extinguishing fluid supply, and including an upstream portion, a downstream portion, and a pressurized fluid supply portion;

(c) a three-way valve having:

(i) a first inlet connected to the fire extinguishing fluid supply via the upstream portion of the piping, and being configured to open and to close;

(ii) a second inlet connected to the pressurized fluid supply portion of the piping, and being configured to open and to close;

(i) an outlet connected to the downstream portion of the piping;

(d) a fire detection unit connected to the three-way valve, and configured to detect ambient temperature, the fire detection unit sending a signal to the three-way valve to cause the three-way valve to open the first inlet and to close the second inlet;

(e) at least one fire protection sprinkler connected to the outlet of the three-way valve via the downstream portion of the piping, and configured to open when the ambient temperature reaches a sprinkler activation temperature;

(f) a first pressurized fluid supply that supplies a pressurized fluid to the pressurized fluid supply portion of the piping;

(g) a second pressurized fluid supply that supplies the pressurized fluid to the pressurized fluid supply portion of the piping; and (h) a pressure maintenance device connected to each of the second inlet of the three-way valve, the first pressurized fluid supply, and the second pressurized fluid supply, the pressure maintenance device including:

(i) a first pressurized fluid unit having:

(1) a first inlet that receives a pressurized fluid from the first pressurized fluid supply;

(2) a first pressure regulator connected to the first inlet, and configured to regulate a pressure of the pressurized fluid received through the first inlet; and (3) a first valve connected to at least the first pressure regulator, and configured to open and to close;

(ii) a second pressurized fluid unit having:

(1) a second inlet that receives the pressurized fluid from the second pressurized fluid supply;

(2) a second pressure regulator connected to at least the second inlet, and configured to regulate a pressure of the pressurized fluid received through the second inlet; and (3) a second valve connected to at least the second pressure regulator, and configured to open and to close;

(iii) a supply pressure sensor connected to at least the first pressurized fluid unit and to the second pressurized fluid unit, and configured to detect the pressure of the pressurized fluid supplied by one of the first pressurized fluid unit and the second pressurized fluid unit;

(iv) a switch connected to at least the first pressurized fluid unit, the second pressurized fluid unit, and the supply pressure sensor, and configured to automatically switch from a primary supply mode, in which the pressurized fluid is supplied through the first pressurized fluid unit, and a secondary supply mode, in which the pressurized fluid is supplied through the second pressurized fluid unit, based on the detected supply pressurized fluid pressure;

(v) a pressurized fluid outlet unit having:

(1) an outlet pressure regulator connected to at least the first pressure regulator, the second pressure regulator, the supply pressure sensor, and the switch, and configured to regulate the pressure of the pressurized fluid downstream of each of the first pressure regulator and the second pressure regulator;

(2) an outlet pressure sensor connected to at least the outlet pressure regulator, and configured to detect an outlet pressurized fluid pressure, and to output the detected outlet pressurized fluid pressure to the switch; and (3) an outlet connected to at least the outlet pressure regulator, the outlet pressure sensor, and the second inlet of the three-way valve via the pressurized fluid supply portion of the piping, and configured to output the pressurized fluid from the pressure maintenance device; and (vi) a bypass unit connected to the pressurized fluid outlet unit and to one of the first pressurized fluid unit and the second pressurized fluid unit, and configured to bypass the corresponding one of the first valve and the second valve to supply the pressurized fluid to the outlet, and configured to open and to close;

(B) operating the switch, when the detected outlet pressurized fluid pressure is greater than or equal to a predetermined outlet pressure and the detected supply pressurized fluid pressure is greater than or equal to a predetermined supply pressure, to maintain the pressure maintenance device in the primary supply mode while the sprinkler system is in a non-activated state;

(C) operating the switch, when the detected outlet pressurized fluid pressure is greater than or equal to the predetermined outlet pressure and the detected supply pressurized fluid pressure is less than the predetermined supply pressure, to switch from the primary supply mode to the secondary supply mode, while the sprinkler system is in the non-activated state, and (D) operating the switch to switch from one of the primary supply mode and the second supply mode to a non-supply mode, in which the pressurized fluid outlet unit does not output the pressurized fluid, each of the first pressurized fluid valve, the second pressurized fluid valve, and the bypass valve is closed, and the fire extinguishing fluid is permitted to flow from the fire extinguishing fluid supply to the at least one fire protection sprinkler through the upstream portion of the piping, the three-way valve, and the downstream portion of the piping when the sprinkler system is in an activated state, wherein the sprinkler system switches from the non-activated state to the activated state when the at least one fire protection sprinkler opens.

33. The method according to claim 32, wherein the bypass unit includes:

(1) a bypass line having a first end connected to the corresponding one of the first pressure regulator and the second pressure regulator, and a second end connected to at least each of the outlet pressure regulator, the outlet pressure sensor, and the outlet; and (2) a bypass valve provided at one of the first end and the second end of the bypass line, the bypass valve configured to open and to close.

34. The method according to claim 33, further comprising (E) closing the bypass valve when the pressure maintenance device is in one of the primary supply mode and the secondary supply mode.

35. The method according to claim 34, further comprising (F) opening the bypass valve to supply the pressurized fluid from the one of the first pressure regulator and the second pressure regulator connected to the bypass line at the first end, so as to rapidly fill the pressurized fluid supply portion and the downstream portion of the piping with the pressurized fluid when the pressure maintenance device is in a bypass mode and the sprinkler system is in the non-activated state.

36. The method according to claim 32, wherein the three-way valve is one of a dry-pipe valve and a preaction valve.

37. The method according to claim 32, wherein the pressurized fluid is one of air and nitrogen.

38. The method according to claim 32, wherein at least one of the first pressurized fluid supply and the second pressurized fluid supply is one of an air compressor, a nitrogen generator, a nitrogen tank, and a series of nitrogen tanks.

39. The method according to claim 32, wherein the fire detection unit sends the signal to the three-way valve when the detected temperature is equal to or greater than a predetermined temperature.

40. The method according to claim 39, wherein the predetermined temperature is in the range of 135° F. to 160° F., inclusive.

41. The method according to claim 32, wherein the fire detection unit sends the signal to the three-way valve when a rate-of-rise of the detected temperature reaches a predetermined rate.

42. The method according to claim 32, wherein the fire detection unit is at least one of a smoke detector and a heat detector.

* * * * *